US005309933A

United States Patent [19]

Nagai et al.

[11] Patent Number: 5,309,933

[45] Date of Patent: May 10, 1994

[54] ONE-HAND OPENABLE AND CLOSABLE UMBRELLA

[75] Inventors: Hisao Nagai, 2-22-15 Gontasaka, Hodogaya-Ku, Yokohama, Japan; Chiu-Hsiung Yang, 40-7, 452 Tayen Road, Peitou District, Taipei, Taiwan

[73] Assignees: Hisao Nagai, Yokohama, Japan; Chiu-Hsiung Yang, Taipei, Taiwan; Wakabayashi & Co., Ltd., Tokyo, Japan

[21] Appl. No.: 36,181

[22] Filed: Mar. 23, 1993

[30] Foreign Application Priority Data

Mar. 30, 1992 [JP] Japan ..... 4-26102
Mar. 30, 1992 [JP] Japan ..... 4-26103

[51] Int. Cl.[5] ..... A45B 25/14

[52] U.S. Cl. ..... 135/24; 135/25.1; 135/25.33; 135/25.4

[58] Field of Search ..... 135/25.1, 19, 25.33, 135/25.4, 25.41, 37–40, 22–24

[56] References Cited

U.S. PATENT DOCUMENTS 3,171,418 3/1965 Meyer ..... 135/25.4 X
3,640,298 2/1972 Weber ..... 135/25.1
3,729,012 4/1973 Weber ..... 135/25.4 X
3,856,030 12/1974 Sato ..... 135/24 X
4,823,821 4/1989 Day ..... 135/24
5,060,684 10/1991 Wu ..... 135/25.41
5,063,952 11/1991 Seidel et al. ..... 135/25.33 X
5,088,512 2/1992 Chou et al. ..... 135/24
5,232,004 8/1993 Wu ..... 135/25.41 X

FOREIGN PATENT DOCUMENTS 1194108 6/1965 Fed. Rep. of Germany ..... 135/24
0539979 2/1957 Italy ..... 135/25.33

*Primary Examiner*—Carl D. Friedman
*Assistant Examiner*—Lan C. Mai
*Attorney, Agent, or Firm*—Emmanuel J. Lobato; Robert E. Burns

[57] ABSTRACT

There is disclosed a one-hand openable and closable umbrella which does not cause relative rotational movement and displacement between an inner shaft and an outer shafts. The inner shaft has a U-shaped groove extending in the lengthwise direction thereof and the outer shaft has a convex block provided inside a lower nest mounted on the top of the outer shaft. By the engagement of the convex block of the outer shaft with the U-shaped groove of the inner shaft, the inner and outer shaft neither turn nor displace relative to each other when the latter slides on the latter. Moreover, since a plastic sleeve is put on the upper and portion of the inner shaft inside a spring mounted thereon, any frictional force between the spring and the inner shaft and between the spring and an upper nest can be decreased, by which the umbrella can be smoothly opened and closed.

4 Claims, 8 Drawing Sheets

ONE-HAND OPENABLE AND CLOSABLE UMBRELLA

BACKGROUND OF THE INVENTION

The present invention relates to a one-hand openable and closable umbrella which can be opened and closed with one hand.

FIG. 9 shows a conventional umbrella of this kind which has previously been proposed by one of the inventors of this application (see Japanese Patent Publication No. 41201/86) and has a double shaft composed of an inner shaft 1*a* and an outer shaft 1*b* which are smoothly slidable relative to each other. A required number (usually eight) of main ribs 2 are pivotally secured at one end to the top of the inner shaft 1*a* so that they extend radially thereof at predetermined angular intervals (360°/8=45° when the number of main ribs 2 is eight). A required number (equal to the number of main ribs, that is, eight) of auxiliary ribs 4 are pivotally secured at one end to the top of the outer shaft 1*b* so that they extend radially thereof at predetermined angular intervals (45° when the number of auxiliary ribs is eight), and as indicated by 2*a*, they pivotally support at the other end the main ribs 2 near the positions where the main ribs 2 are secured to the inner shaft 1*a*. A handle 6*a* is mounted on the lower end portion of the outer shaft 1*b* and an auxiliary handle 6*b* is attached to the lower end of the inner shaft 1*a*. A coiled spring 5 is mounted on the upper and portion of the inner shaft 1*a* so that it provides a force between the outer shaft 1*b* and the inner shaft 1*a* in a direction in which to cause the upper end portion of the outer shaft 1*b* to approach the upper end portion of the inner shaft 1*a*. On the handle 6*a* there is provided a control button 7*a* as a releasable locking mechanism for temporarily inhibiting the relative sliding movement of the outer shaft 1*b* and the inner shaft 1*a*. When the control button 7*a* is depressed, the temporary inhibition of the relative sliding movement of the shafts is released. The relative sliding movement can be temporarily inhibited again in a state in which the positional relationship between the outer shaft 1*b* and the inner shaft 1*a* has been changed while the handle 6*a* has been brought down to the vicinity of the auxiliary handle 6*b*, closing the main ribs 2 (a first state).

When the umbrella is held in its folded state, the handle 6*a* is normally in contact with the auxiliary handle 6*b*. When depressing the control button 7*a* with one finger of the hand holding the handle 6*a* so as to open the umbrella, the inner shaft 1*a* is slid down relative to the outer shaft 1*b* by the elastic force of the spring 5, by which the auxiliary ribs 4 act to spread out the main ribs 2, opening the umbrella. The umbrella can be used in such a state, but when it is desirable to fix the main ribs at their fully opened position on a windy day, for example, the auxiliary handle 6*b* mounted on the lower end portion of the inner shaft la is pulled down away from the handle 6*a* with a finger of the hand holding the umbrella, by which the umbrella is put in such a second state as shown in FIG. 5, in which the outer shaft 1*b* and the inner shaft 1*a* are locked to each other.

In the case of closing the umbrella, the control button 7*a* is depressed with a finger of the hand holding the handle 6*a*, the tip of the outer shaft 1*b* is slightly pulled away from the tip of the inner shaft 1*a* under the action of the coiled spring 5 and the auxiliary ribs 4 are closed, by which the main ribs 2 are slightly moved in the direction to be closed. The coiled spring 5 is not so stiff, as mentioned previously; so that, by lightly pulling the handle 6*a* toward the auxiliary handle 6*b* which is pressed against an user's body, for example, the main ribs, slightly closed as mentioned above, are fully closed with ease, and hence the umbrella is folded up with the outer shaft 1*b* and the inner shaft 1*a* locked to each other.

In this prior art example, however, the positions 2*a* of the auxiliary ribs 4 supporting the main ribs 2 are relatively close to the inner shaft 1*a* (about 7 to 10 cm) when the umbrella is open, and consequently, in the case where the wind is high, the main ribs 2 and cloth spread thereon may become slack, making the umbrella unstable in its opened state.

By locating the positions 2*a* away from the center of the umbrella, the main ribs 2 can be made stable in its opened state, but the auxiliary handle 6*b* further extends downwardly of the handle 6*a* accordingly, making the umbrella unhandy to use and unshapely.

It is an umbrella shown in FIG. 10 to solve the above-mentioned defects (see Japanese Utility Model Public Disclosure No. 169116/89). This umbrella is provided with lateral auxiliary ribs 4*a* in addition to the auxiliary ribs 4 in the prior art example shown in FIG. 9. The outer ends of the lateral auxiliary ribs 4*a* pivotally support the main ribs substantially centrally thereof as indicated by reference, numeral 2*b*, and the inner ends are pivotally secured to the inner shaft 1*a* as indicated by reference numeral 4*b*. Furthermore, the lateral auxiliary ribs 4*a* are each pivotally supported by the upper end of the corresponding auxiliary rib 4 at a position of about ⅓ of the entire length of the rib 4*a* from the inner end thereof as indicated by reference numeral 4*c*. With such an arrangement, the lateral auxiliary ribs 4*a* are substantially horizontal as shown when the main ribs 4 are fully opened. The spring 5 is shown to be in its contracted state, and its expanding elastic force is utilized for opening and closing the umbrella. The upper end of the spring 5 is fixed to the inside of a ferrule mounting member 8.

When the control button 7*a* is depressed to open the umbrella, the spring 5 is still contracted but, by its expanding elastic force, the main ribs 2 starts to be spread out. At the time point when the main ribs 2 reach their fully opened position as depicted in FIG. 10, that is, when the lateral auxiliary ribs 4*a* assume their substantially horizontal position, the elastic force of the spring 5 acts effectively, by which the main ribs 2 are pressed against the cloth tied thereto. At this time, the relative sliding movement of the inner shaft 1*a* and the outer shaft 1*b* is inhibited by a stopper 9*b*.

A hole for locking the umbrella in its opened state needs only to be provided, if necessary. Where the umbrella is manufactured for use under special conditions, for example as a golf umbrella, the provision of such a hole is the inner shaft 1*a* will make the umbrella more stable when it is put up.

The prior art examples described above both have a construction in which the inner and outer shafts are engaged with each other and they have an upper nest and a lower nest secured thereto, respectively, but no structure is provided for their engagement. With such a construction, while the umbrella is in use, the inner shaft and the outer shaft readily turn or displace relative to each other and under the action of an external force or due to abnormal handling of the umbrella by its user, but it does not matter usually. In the case of opening or closing the umbrella, however, there is a fear that its ribs are easily twisted, causing trouble in the opening or closing of the umbrella. Moreover, in the prior art examples the spring is directly put on the top end portion of the inner shaft above the upper nest. When the umbrella is opened and closed, any friction between the spring and the outside of the top end portion of the inner shaft is always caused by the expansion and contraction of the spring. Since the both are made of metal alone, their friction is very likely to make a harsh grating noise. Besides, their surfaces are liable to damage by their long-term friction, and since the user usually stands the umbrella with the ferrule downward, there is a fear that rain water flows between the inner shaft and the spring and causes the top end portion of the inner shaft and the inside of the spring to corrode, shortening the service life of the umbrella in its entirety.

In the prior art examples, the inner shaft has a stopper provided thereon at an appropriate position and as the umbrella is opened, the outer shaft slides on the inner shaft to a predetermined position where the lower nest strikes against the stopper when the umbrella is fully opened. The stopper serves as a positioning means, but in practice, an appreciably severe shock is given to the umbrella whenever the lower nest bumps against the stopper. This is not comfortable to the user. If the user does not firmly hold the handle, the user may let go of the umbrella in spite of oneself. This is considerably dangerous.

SUMMARY OF THE INVENTION

An object of the present invention is to provide a one-hand openable and closable umbrella of a construction which are free from relative rotational movement of the inner shaft and the outer shaft, and hence alleviates their friction and lengthens the service life of the umbrella.

To attain the above object, the one-hand openable and closable umbrella of the present invention has a construction wherein the inner shaft has a U-shaped groove provided thereon to be extended in the lengthwise thereof and a lower nest, mounted on the top end portion of the outer shaft, has a convex block on the inside thereof for engagement with the U-shaped groove of the inner shaft. The outer shaft is put on the inner shaft with the convex block of the lower nest received in the U-shaped groove. With this arrangement, when the outer shaft slides on the inner shaft, they neither turn nor displace relative to each other. This ensures smooth, shock-free opening and closing of the umbrella and, at the same time, prevents twisting of the umbrella ribs which may cause trouble in opening and closing of the umbrella. Hence, the umbrella of the present invention is long-lived.

Moreover, a plastic sleeve is put on the top end portion of the inner shaft inside of the spring to effectively reduce any friction between the spring and the inner shaft. This prevents the generation of harsh grating noises by their friction and precludes the possibility of their corrosion which results from wear of their surfaces by friction.

Furthermore, buffer means is mounted on the inner shaft at an appropriate position between the upper nest and the lower nest and a buffer spring is put on the inner shaft. This arrangement properly absorbs the shock which is applied to the lower nest when the umbrella is opened; accordingly, no unnecessary shock is applied to the entire structure of the umbrella. Hence, the umbrella of the present invention is handy to use and stout against an abnormal shock.

In addition to the above mentioned structure, a sliding rod secured to the lower end of the inner shaft has also a convex block at an appropriate position on the inside thereof for engagement with the U-shaped groove of the inner shaft. This construction allows ease in positioning of the respective parts during assembly and causes the control button base and the rod to act as guides, preventing relative displacement of the inner and outer shafts. Hence, the umbrella of the present invention is handy to use and stable while in use.

Moreover, two-stage assembling is adopted for the auxiliary handle which is fixed to the lower end of the outer shaft. By coupling the rod and the auxiliary handle to each other before the latter is attached to the outer shaft, there is no need of opening the umbrella during assembly. At first, the sliding rod is affixed to the lower end portion of the inner shaft, the handle is put on the rod and then fixed to the outer shaft just under the control button base mounted on the lower end portion of the outer shaft, after which the curved or bulged auxiliary handle is coupled to the lower end of the rod. Thus, the umbrella need not be opened during assembly. This permits easier fabrication of umbrellas.

BRIEF DESCRIPTION OF THE DRAWINGS

The present invention will be described in detail below with reference to accompanying drawings, in which.

DETAILED DESCRIPTION

Figure 1:
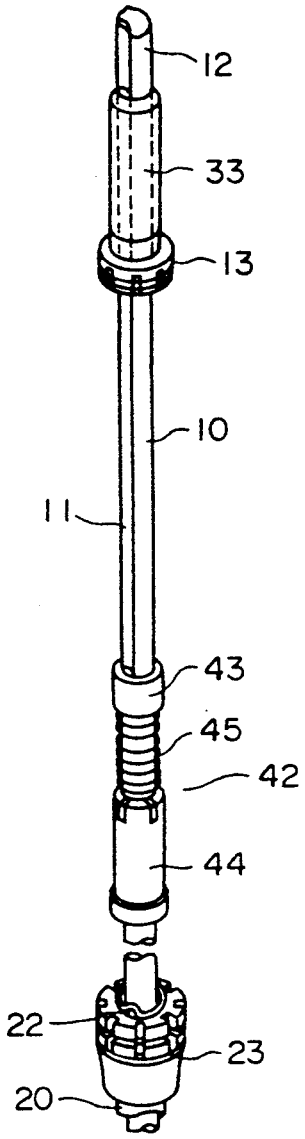
FIG. 1 is a schematic diagram showing parts of inner and outer shafts associated therewith in the present invention.

FIG. 1 is a schematic diagram showing an inner shaft 10 and an outer shaft 20 and their associated parts in the present invention, from which the structural feature of the invention can be seen. The inner shaft 10 has a U-shaped groove 11 extending in the lengthwise direction thereof, whereas the outer shaft 11 has a convex block 22 provided thereon inside a lower nest 23 for engagement with the groove 11 of the inner shaft 10. The inner shalf 10 has a plastic sleeve 33 put on its top end portion 12 just above an upper nest 13. On the inner shaft 10 a buffer means 42 is mounted between the upper nest 13 and the lower nest 23 mounted at the top of the outer shaft 11. The buffer means 42 comprises a buffer ring 43, a fixed ring 43 fixedly mounted on the inner shaft 10 at one end of the buffer spring 45 and a strong ring 44 connected at the other end of the buffer spring 45 to slide on the inner shaft 10.

Figure 2:
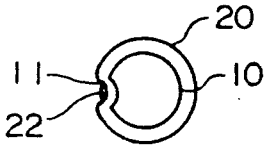
FIG. 2 is a sectional view showing the engagement of a convex block of the outer shaft and a U-shaped groove of the inner shaft with each other.

FIG. 2 clearly shows, in section, the manner in which the convex block 22 of the outer shaft 20 is received in the U-shaped groove 11 of the inner shaft 10. With this structure, where the outer shaft 11 slides on the inner shaft 10, they neither turn nor displace relative to each other and the umbrella can be opened and closed smoothly. In addition, since the umbrella ribs are not twisted, no trouble is caused in the opening and closing of the umbrella; therefore, the service life of the umbrella can be lengthened.

Figure 3:
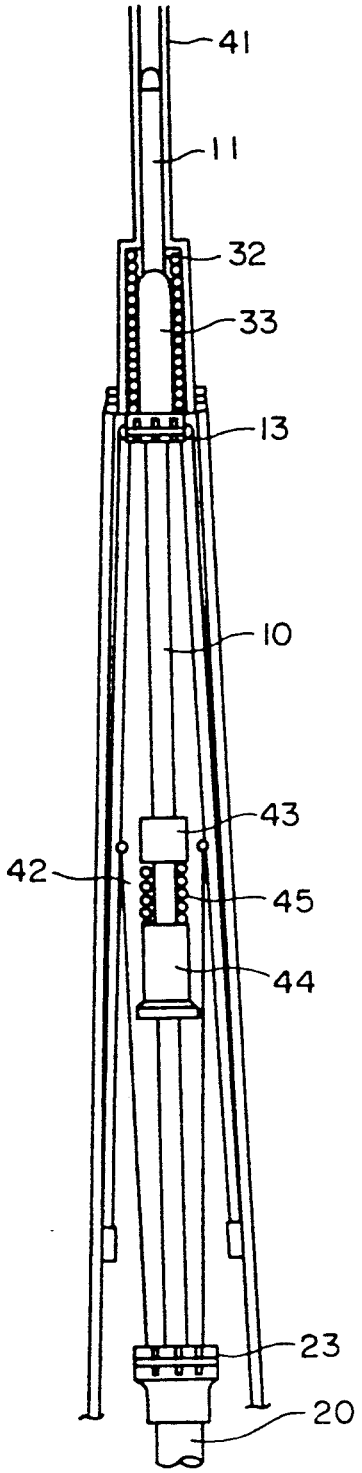
FIG. 3 is a schematic diagram showing the umbrella of the present invention in its folded state.
Figure 4:
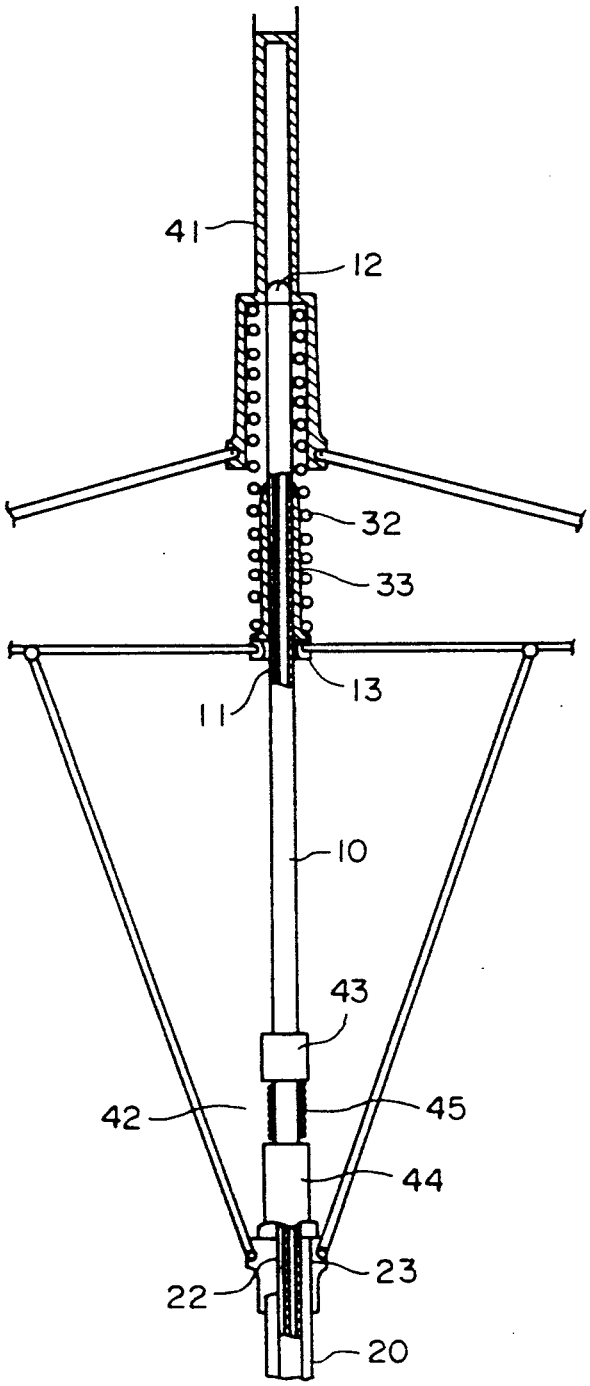
FIG. 4 is a schematic diagram showing the umbrella of the present invention in its opened state.

FIG. 3 schematically shows the umbrella of the present invention in its folded state and FIG. 4 the umbrella in its opened state. According to the present invention, by inserting a plastic sleeve 33 in the inside of a spring 32 put on the top end portion 12 of the inner shaft 10 as shown, it is possible to prevent friction between the spring 32 and the inner shaft 10 and between the spring 32 and the inner wall of the upper nest 13 when the umbrella is opened and closed. This prevents the generation of noises by their rubbing against each other and the wear of their surfaces which leads to their corrosion. Thus, the umbrella of the present invention is stoutly-built and long-lived.

In the one-hand openable and closable umbrella of the present invention, buffer means 42 including a buffer spring 45 is mounted on the inner shaft 10 at an appropriate position between the upper nest 13 and the lower nest 23 so that it suitably absorbs the shock that is applied to the lower nest 23 when the umbrella is opened. In case of opening the umbrella, the outer shaft 20 slides on the inner shaft 10 and the lower next 21 bumps against a stopper ring 44 of the buffer means 42. The stopper ring 44 is slidable on the inner shaft 10, and since the buffer spring 45 is held between the stopper ring 44 and a fixed ring 43 fixedly mounted on the inner shaft 10, it is possible to effectively absorb the shock that is applied to the lower nest 23 attached to the top of the outer shaft 20. Thus, the overall structure of this umbrella prevents the generation of unnecessary shocks, allows ease in using the umbrella and precludes the possibility of its structural breakdown by abnormal shocks.

Figure 8:
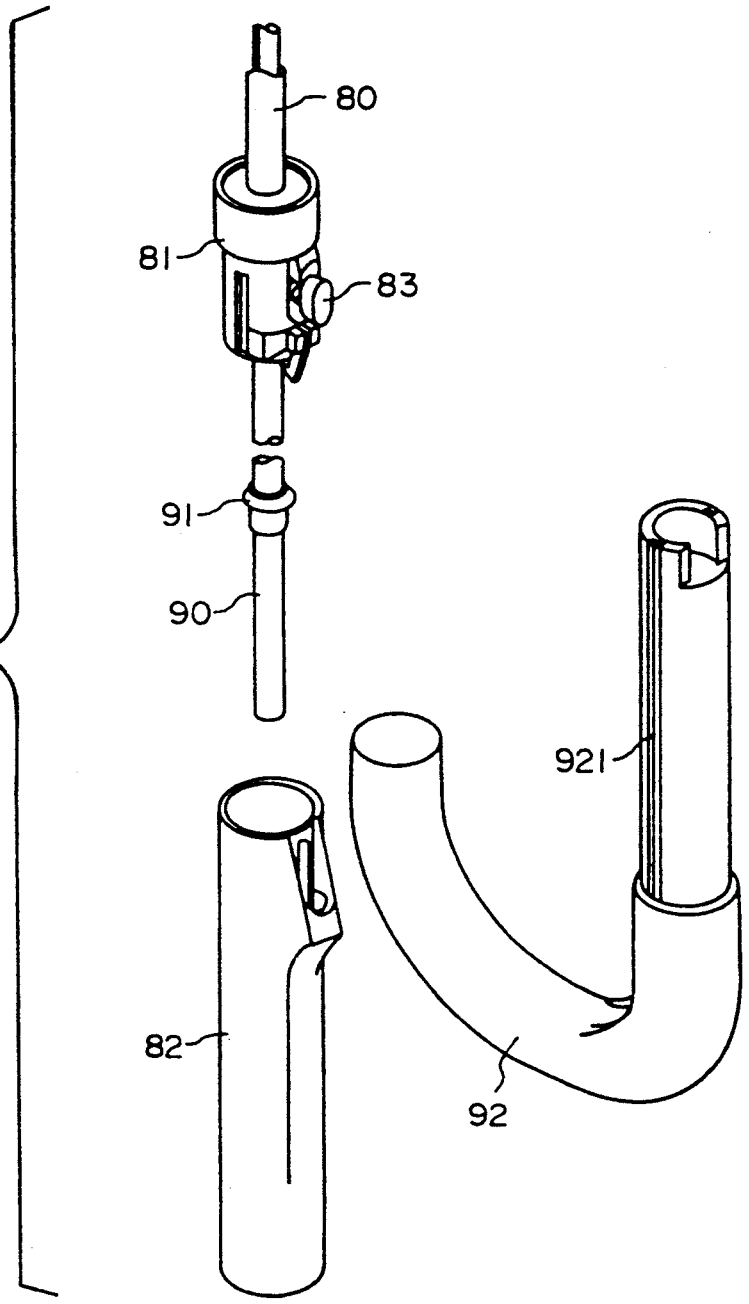
Fig. 8 PRIOR ART
FIG. 8 is an exploded view of the principal part of a conventional one-hand openable and closable umbrella.
Figure 9:
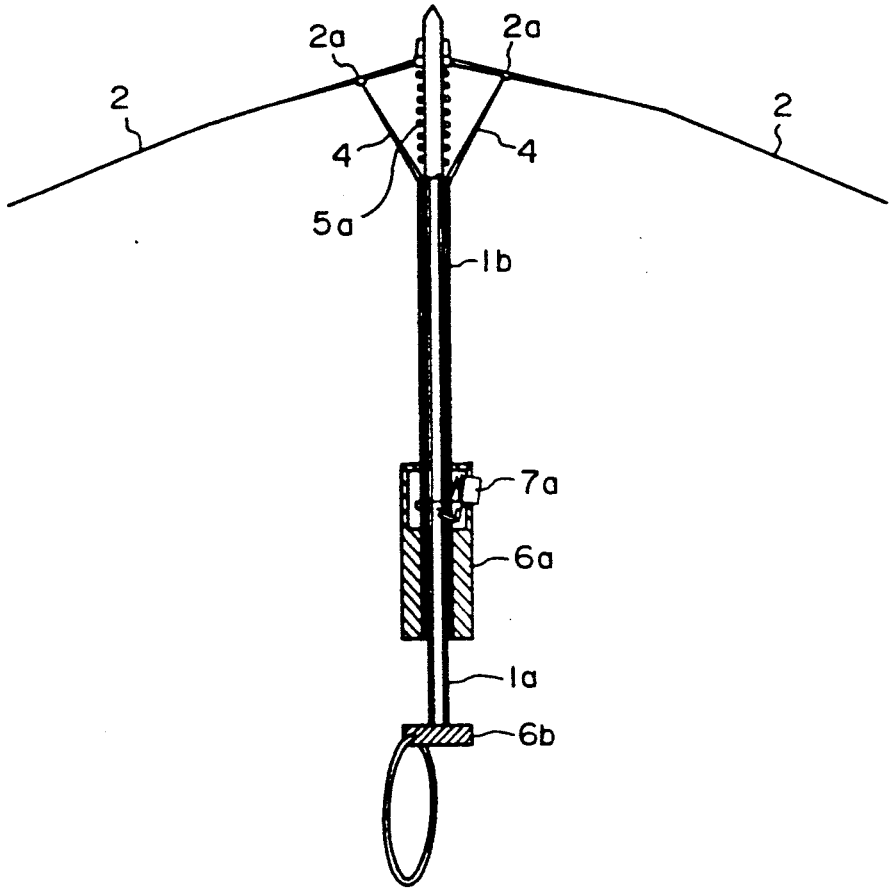
PRIOR ART Fig. 9
FIG. 9 is a front view schematically showing an example of the construction of a conventional one-hand openable and closable umbrella.
Figure 10:
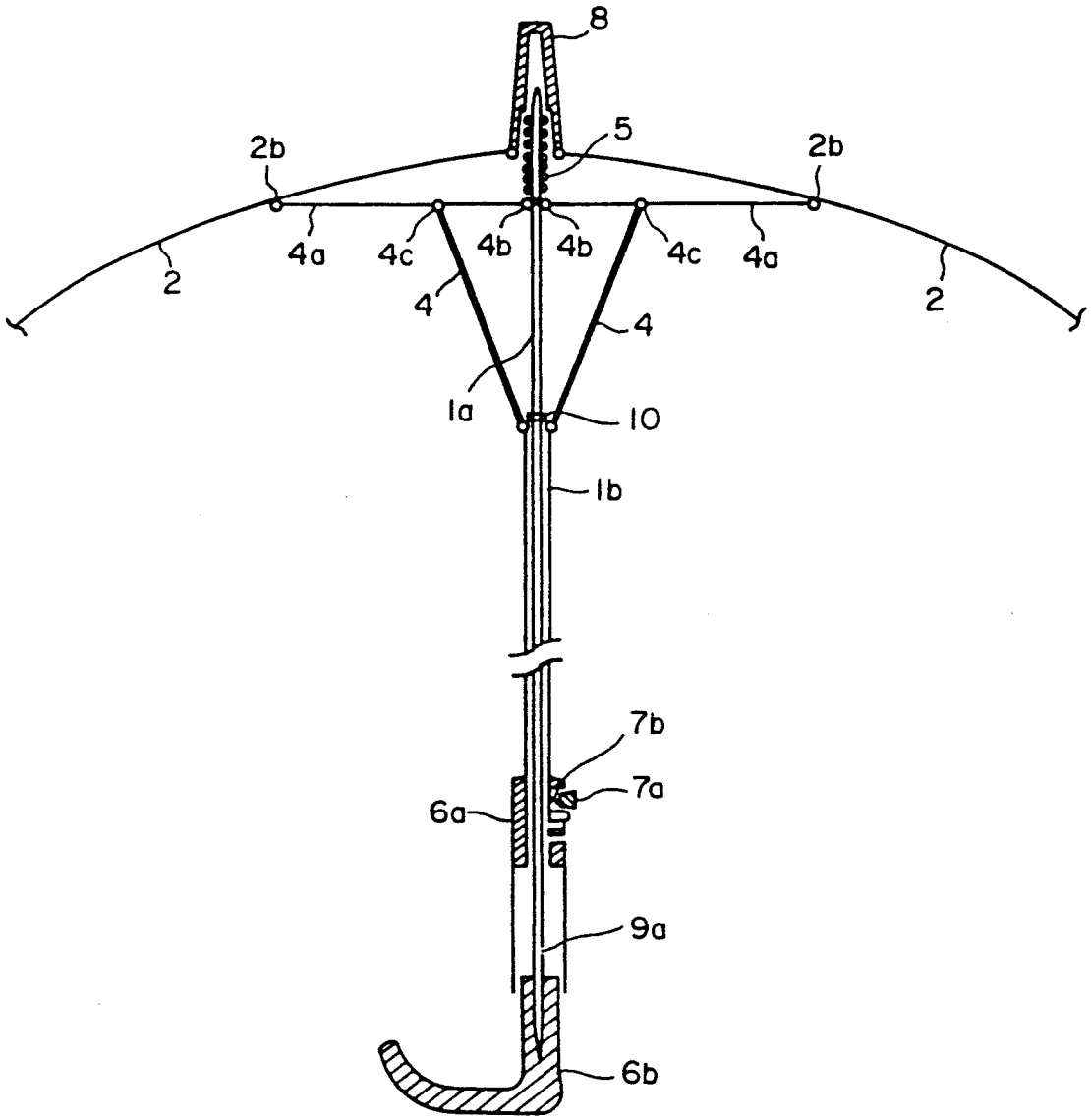
PRIOR ART Fig. 10
FIG. 10 is a front view schematically showing another example of the construction of the conventional one-hand openable and closable umbrella.

The above-described conventional one-hand openable and closable umbrella, such as shown in FIG. 10, has one curved or bulged auxiliary handle attached to the lower end of the inner shaft, and this is a conventional design which follows users' practice. It is true that the design of such a curved or bulged auxiliary handle makes the umbrella easy to hold and carry, but the design presents much difficulty in assembling of one-hand openable and closable umbrella. Referring now to FIG. 8 which is a schematic exploded view showing a conventional structure of such an auxiliary handle, a control button 83 is fitted in the skirt of a control button base 81, a ring 91 is fixedly mounted on an inner shaft 90 to stop the control botton base 81 and an auxiliary handle 92 is fixed to the inner shaft 90 below the fixed ring 91. The auxiliary handle 92 has, at its upper end, a sliding rod 921 on which a handle 82 is slidable.

In assembling, the control button base 81 is fixed to the lower end of an outer shaft 80, the ring 91 is fixed to the inner shaft 90, the inner shaft 90 is inserted into the outer shaft 80 and the shaft assembly is coupled to an umbrella structure. In the assembling of umbrellas, the next step is most difficult. The auxiliary handle 92 and the handle 82 are assembled after assembling of umbrella ribs. The auxiliary handle 92 is coupled to the handle 82 after the latter is affixed to the lower end of the inner shaft 90. If the auxiliary handle 92 is first coupled to the handle 82, then the handle 82 cannot be affixed to the inner shaft 90 at a predetermined position because of the curved or bulged structure of the auxiliary handle 92. In this instance, the auxiliary handle 92 needs to be fixed to the lower end of the inner shaft 90; so that when the handle 82 is affixed to the lower end of the inner shaft 90, the handle 82 is moved on the outer shaft 80 with the umbrella opened, after which the rod 921 extending upward of the auxiliary handle 92 is fixed to the lower end of the inner shaft 90. Thus, the assembly is not efficient.

In case of assembling respective parts of the umbrella, if the auxiliary handle 92 and the handle 82 cannot assembled with the umbrella closed, they can be assembled on a proper assembly line, because the cloth is not tied to umbrella ribs. With the conventional design of the auxiliary handle 92, it is necessary to fix the auxiliary handle 92 to the inner shaft 90 after opening the umbrella first and then pushing up the handle 82 affixed to the lower end of the inner shaft 90. To open the umbrella is appreciably troublesome and the opened umbrella is considerably large in volume; hence, it consumes much space in assembling. This makes the arrangement of the assembly line difficult and the opened umbrella is very dangerous to workers during assembly.

In the above-described conventional examples, the inner shaft 90 is cylindrical and the inner hole of the rod 921 of the auxiliary handle 92 is also round. Accordingly, their positioning is difficult during assembly and they are likely to turn or displace relative to each other by any external force while the umbrella is used, with the result that the control button base 81 moved out of place, making the handling of the umbrella difficult.

Figure 5:
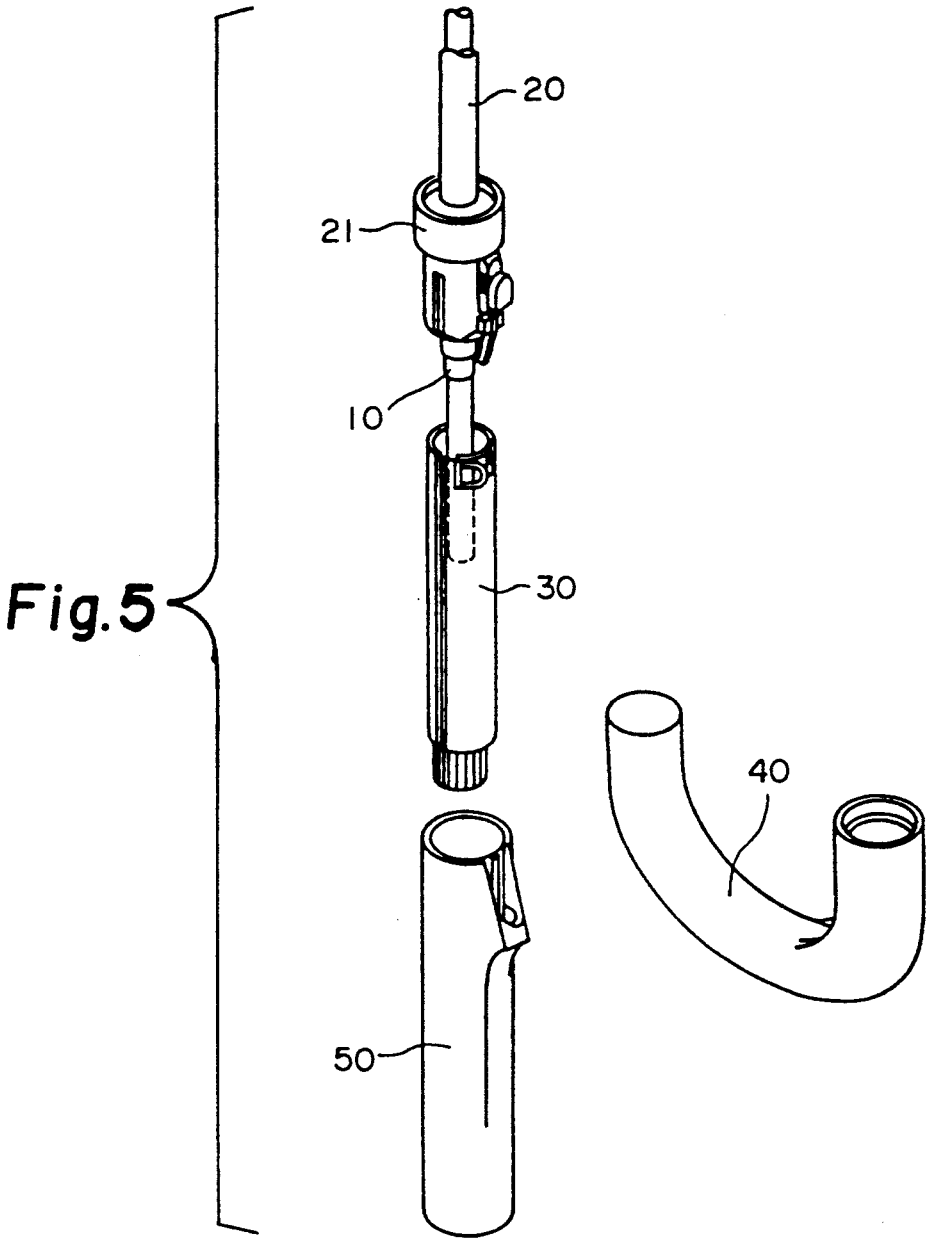
FIG. 5 is an exploded view of the principal part of the present invention.

The above defects of the conventional one-hand openable and closable umbrella can be overcome by an embodiment of the present invention shown in FIG. 5, in which a sliding rod 30 and an auxiliary handle 40 are assembled in two stages. According to the present invention, the sliding rod 30 can be secured to the lower end of an inner shaft 10 before the former is inserted into the auxiliary handle 40. During assembly the umbrella need not be opened. After fixing the sliding rod 30 to the inner shaft 10, a handle 50 is put on the sliding rod 30 and fixed to the outer shaft 20 immediately below a control button base 21, followed by a step of coupling the auxiliary handle 40 to the lower end of the sliding rod 30, thus completing the assembly.

According to the present invention, since the auxiliary handle 40 and the sliding rod 30 have two-stage structure as mentioned above, the handle 50 need not be inserted in the lower end portion of the inner shaft 10 first in the case of coupling the sliding rod 30 to the lower end of the inner shaft 10, and the umbrella need not be opened during assembly, besides the sliding rod 30 can be fixed to the inner shaft 10 simply by moving up the outer shaft 20. Hence, the assembly line can be facilitated. Furthermore, the assembly line can be easily arranged. When the sliding rod 30 has been fixed to the lower end of the inner shaft 10, it is possible to couple the handle 50 on the sliding rod 30 and fix it to the skirt of the control button base 21 at the lower end portion of the outer shaft 20. By fixing the curved or bulged auxiliary handle 40 to the lower end of the sliding rod 30 finally, the assembly is completed. Thus, the afore-mentioned defects of the prior art examples can be overcome.

Figure 6:
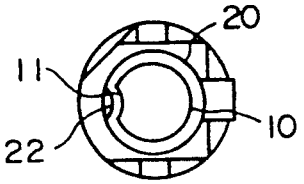
FIG. 6 is a sectional view of a control button base portion for use in the present invention.

FIG. 6 shows the sectional structure of the control button base portion in the present invention. As shown, the inner shaft 10 has a U-shaped groove 11 extending in the lengthwise direction thereof and the lower end portion of the outer shaft 20, on which the control button base 21 is mounted, has a convex block 22 for engagement with the U-shaped groove 11. The convex groove 22 is received in the U-shaped groove 11 of the inner shaft 10 and serves as a guide when the outer shaft 20 slides on the inner shaft 10. With this structure, the outer shaft 20 and the inner shaft 10 do not turn or displace relative to each other while in use and the umbrella can be used with stability.

Figure 7:
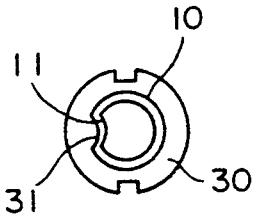
FIG. 7 is a sectional view of sliding rod portion in the present invention.

FIG. 7 shows the sectional structure of the sliding rod 30 in the present invention. Since the sliding rod 30, which is fixed to the lower end portion of the inner shaft 10, also has an inwardly convex block 31 for engagement with the U-shaped groove 11 of the inner shaft 10 as shown, positioning of the sliding rod 30 is easy and accurate when it is coupled on the inner shaft 10. Moreover, once the umbrella has been assembled, the convex block serves as a guide for the sliding rod 30, the control button base 21 and the inner shaft 10 and prevents the inner shaft 10 and the outer shaft 20 from turning or displacing relative to each other. Thus, the umbrella can be used with stability.

As will be appreciated from the above, the present invention brings about simple improvements on the inner shaft and auxiliary handle in the afore-mentioned prior art examples and attains the intended object, and hence possesses originality and inventiveness over the prior art examples.

What we claim is:

1. A one-hand openable and closable umbrella comprising:

a double shaft composed of an inner shaft and an outer shaft which are smoothly slidable relative to each other;

a plurality of main ribs pivotally secured at one end to a mounting member on the tip of the inner shaft at predetermined angular intervals;

a plurality of auxiliary ribs having inner ends pivotally secured, at predetermined angular intervals, to a lower nest provided at the upper end portion of the outer shaft;

a plurality of lateral auxiliary ribs having outer ends pivotally supporting said plurality of main ribs substantially centrally thereof, the inner ends of which are pivotally secured to an upper nest provided at the upper end portion of the inner shaft, and which are pivotally supported at their intermediate portion by the outer ends of the plurality of auxiliary ribs;

a handle mounted on a lower end portion of the outer shaft;

an auxiliary handle attached to a lower end portion of the inner shaft;

a spring for providing an elastic force between the outer shaft and the inner shaft in a direction to cause the upper end portion of the outer shaft to approach the upper end of the inner shaft;

an releasable locking mechanism which temporarily inhibits the relative sliding movement of the outer shaft and the inner shaft in a first state in which the main ribs have been folded through the action of the auxiliary ribs by moving the handle toward the auxiliary handle against the elastic force of the spring; and a stopper which temporarily inhibits the relative sliding movement of the outer shaft and the inner shaft in a second state in which the elastic force of the spring has been reduced by moving the handle away from the auxiliary handle to spread out the main ribs through the action of the auxiliary ribs;

the inner shaft having a U-shaped groove provided thereon extending lengthwise thereof and the outer shaft having a convex block provided inside the lower nest mounted on the top of the outer shaft for engagement with the U-shaped groove so that when the outer shaft slides on the inner shaft, they neither turn nor displace relative to each other.

2. A one-hand openable and closable umbrella according to claim 1, further comprising a plastic sleeve disposed in the inside of the spring at the supper end portion of the inner shaft effectively reducing any friction force between the spring and the inner shaft when the umbrella is opened and closed.

3. A one-hand openable and closable umbrella according to claim 1, wherein buffer means is provided, as said stopper, on the inner shaft at an appropriate position between the upper and lower nests, the buffer means comprising a buffer spring, a fixed ring fixedly mounted on the inner shaft at one end of the buffer spring and a stopper ring connected at the other end of the buffer spring to slide on the inner shaft and contact with the lower nest.

4. A one-hand openable and closable umbrella acording to claim 1 or 2 or 3, in which a sliding rod is fixed to the lower end of the inner shaft, the auxiliary handle of a curved or bulged configuration being secured to a lower end of the sliding rod;

the inner shaft having a U-shaped groove along a lengthwise direction thereof, the outer shaft on which the stopper is fixedly mounted having a convex block for engagement with the U-shaped groove and the sliding rod also having a convex block for engagement with the U-shaped groove; and in assemblying, the sliding rod is fixed to the lower end of the inner shaft at first, the handle is coupled on the sliding rod and secured to the lower end of the outer shaft, the auxiliary handle is coupled to the lower end of the sliding rod guided between the sliding rod and the inner shaft.

* * * * *